US005482064A

United States Patent [19]

Goddard

[11] Patent Number: 5,482,064

[45] Date of Patent: Jan. 9, 1996

[54] CLEANING APPARATUS

[75] Inventor: Fenton Goddard, Perth, Australia

[73] Assignee: Robowash Pty Ltd., Welshpool, Australia

[21] Appl. No.: 290,796

[22] PCT Filed: Dec. 3, 1992

[86] PCT No.: PCT/AU92/00652

§ 371 Date: Jun. 6, 1994

§ 102(e) Date: Jun. 6, 1994

[87] PCT Pub. No.: WO93/10914

PCT Pub. Date: Jun. 10, 1993

[30] Foreign Application Priority Data

Dec. 3, 1991 [AU] Australia ..... PK9824

[51] Int. Cl.[6] ..... B08B 3/02

[52] U.S. Cl. ..... 134/57 R; 134/93; 134/98.1; 134/99.1; 134/112; 134/138; 134/143; 134/146; 134/153; 134/177; 134/199; 134/200

[58] Field of Search ..... 134/57 R, 57 D, 134/58 R, 58 D, 93, 98.1, 99.1, 99.2, 100.1, 112, 115 R, 138, 139, 143, 146, 153, 177, 199, 200

[56] References Cited

U.S. PATENT DOCUMENTS

| | | | |
|---|---|---|---|
| 1,405,243 | 1/1922 | Wing | 134/153 |
| 3,020,918 | 2/1962 | Albertson et al. | 134/98.1 |
| 3,679,483 | 7/1972 | Zweig | 134/46 |
| 3,881,328 | 5/1975 | Kleimola et al. | 134/100.1 X |
| 3,973,989 | 8/1976 | Senger | 134/138 X |
| 4,038,155 | 7/1977 | Reber | 134/200 X |
| 4,213,475 | 7/1980 | Minkin . | |
| 4,285,352 | 8/1981 | McMahon et al. | 134/100.1 X |
| 4,433,698 | 2/1984 | Blaul . | |
| 4,741,351 | 5/1988 | Minkin . | |
| 4,744,379 | 5/1988 | Goettel . | |
| 4,768,531 | 9/1988 | Anderson . | |
| 4,842,001 | 6/1989 | O'Leary | 134/138 X |
| 4,995,409 | 2/1991 | Watts . | |

FOREIGN PATENT DOCUMENTS

| | | |
|---|---|---|
| 61061/73 | 4/1975 | Australia . |
| 71464/74 | 1/1976 | Australia . |
| 0443421 | 8/1991 | European Pat. Off. . |
| 2452978 | 10/1980 | France . |
| 89/03192 | 4/1989 | WIPO . |

*Primary Examiner*—Philip R. Coe
*Attorney, Agent, or Firm*—Townsend and Townsend and Crew

[57] ABSTRACT

The specification discloses a cleaning apparatus (2) for cleaning machine and engine parts comprising a trough (4) in which the cleaning is performed. A lid (6) is connected to the trough (4) and is movable between a closed position covering the trough and an opened position allowing access to the trough. A first cleaning fluid dispenser in the form of a manifold (8) is located within the apparatus (2). Also provided is a portable cleaning fluid dispensing gun (10) or brush (12) which is connectable to the apparatus (2). The lid (6) operatively cooperates with the manifold (8), gun (10) or brush (12) so that when the lid (6) is in the closed position, cleaning fluid is dispensed through the manifold (8) and when the lid (6) is in the opened position, cleaning fluid can be dispensed through the gun (10) or brush (12). A pump (14) is provided for pumping the cleaning fluid to the manifold (8), gun (10) or brush (12). A supply of the cleaning fluid is held within the tank (8) formed integrally with the apparatus (2). A ball valve (32) housed within the pump (14) selectively directs cleaning fluid to the manifold (8) or with the gun (10) and brush (12). The ball valve (32) is provided with a control arm (34), the manipulation of which changes the state of the ball valve. The control arm (34) is pivotably connected to one end of a lever (36). An opposite end of the lever (36) is pivotably connected by pivot pin (37) to arms (38 and 39). An end of the arm (38) distant from lever (36) is pivotably connected to an outside wall of the trough (4) in the vicinity of the lid (6). An end of arm (39) is pivotably connected to the lid (6). By this arrangement of levers, the opening or closing of the lid (6) changes the state of the ball valve (32).

29 Claims, 7 Drawing Sheets

CLEANING APPARATUS

FIELD OF THE INVENTION

The present invention relates to a cleaning apparatus and, in particular, but not exclusively, to a cleaning apparatus for cleaning articles covered with an oil-based product.

BACKGROUND OF THE INVENTION

There has always been the need in industries such as for example, the automotive, oil and mining industries to clean mechanical parts covered with grease and grime. For example, when servicing or repairing an internal combustion engine, components such as nuts, bolts, washers, seals, bearings, engine blocks, crank shafts etc., must be thoroughly cleaned prior to reassembly in order to remove all oil, grease and foreign bodies. Foreign bodies such as grit or metal shavings can block cooling or lubrication ducts as well as increase engine wear. Various parts for example, brake shoes or pads and rubber seals must be free of grease or oil to ensure correct operation or prevent premature deterioration.

A "solvent sink" is presently used to clean mechanical parts comprising a large sink and pump for pumping a petroleum based solvent from a separate drum to a dispensing hand piece. The article to be cleaned is held in or above the sink and solvent is pumped from the drum through the hand piece in order to clean the part. While the solvent sink is relatively effective in cleaning, it has a number of inherent deficiencies. It is particularly inefficient as it requires an operator to stand at the sink and manually clean even the smallest of parts. In addition, it is unable to effectively and efficiently clean parts which are too large to fit within the sink. For this reason, it is common to purchase a separate steam cleaning apparatus to clean the "larger" parts. Furthermore, the use of petroleum based solvents creates a fire hazard, is a health hazard to the operator by virtue of vapours given off by the solvent, and is environmentally damaging by virtue of either damaging the earth's ozone layer or contaminating water supplies.

SUMMARY OF THE INVENTION

It is an object of the present invention to provide a cleaning apparatus that attempts to alleviate at least one of the above described deficiencies.

According to the present invention there is provided a cleaning apparatus for cleaning articles, said apparatus comprising:

a trough in which cleaning of said articles can be performed;

a lid connected to said trough and movable between a closed position covering said trough and an opened position to allow access to said trough;

a first cleaning fluid dispensing means located within said apparatus and a second portable cleaning fluid dispensing means;

a receptacle for containing a volume of said cleaning fluid, said receptacle communicating with said dispensing means and said trough so that cleaning fluid can be recirculated through said apparatus; and, pumping means for pumping said cleaning fluid to said first and second cleaning fluid dispensing means, wherein said lid operatively cooperates with said pumping means in a manner such that when the lid is in the closed position, the pumping means can pump the cleaning fluid to said first cleaning fluid dispensing means, and when the lid is in the opened position, the pumping means can pump the cleaning fluid to the second portable cleaning fluid dispensing means.

Preferably said pumping means includes a valve for selectively directing cleaning fluid to said first or second dispensing means wherein said valve is operated by moving said lid between the closed and opened positions.

Preferably said lid is connected to said valve by a lever for operating said valve.

Alternatively, said apparatus may further comprise electrical control means for operating said valve, said electrical control means including an associated switch, wherein said associated switch activates said electric control means to cause said valve to direct cleaning fluid to the first dispensing means when the lid is in the closed position, and to cause the valve to direct cleaning fluid to the second dispensing means when the lid is in the opened position.

Alternately said pumping means comprises a first pump in communication with said receptacle for pumping said cleaning fluid to said first cleaning fluid dispensing means and a second pump in communication with said receptacle for pumping said cleaning fluid through said second portable cleaning fluid dispensing means, whereby, said lid when in said closed position enables said first pump to pump cleaning fluid through said first cleaning fluid dispensing means and said lid when in the opened position enables the second pump for pumping cleaning fluid through said second portable cleaning fluid dispensing means.

Preferably said apparatus further comprises a basket disposed within the trough for holding said articles, said basket adapted to allow cleaning fluid to flow therethrough.

Preferably said apparatus further comprises means for rotating said basket to vary the position of an article contained in the basket relative to one of said cleaning fluid dispensing means.

Preferably said means for rotating comprises a jet of cleaning fluid, a support for the basket, a plurality of vanes connected to said support can successively enter said jet of cleaning fluid to act as impellers to rotate said support.

Preferably the basket is rotated automatically on the lid being placed in the closed position.

Preferably said apparatus further comprises a filter means communicating between said receptacle and said pumping means.

Preferably said cleaning fluid is a combination of water and detergent.

Preferably said cleaning fluid is heated prior to dispensing through said first or second dispensing means.

Preferably said second cleaning fluid dispensing means comprises a hand held fluid dispensing gun or a hand held fluid dispensing brush.

An embodiment of the present invention will now be described by way of example only, with reference to the accompanying drawings in which:

DETAILED DESCRIPTION OF THE PREFERRED EMBODIMENTS

Figures 1, 1A, 1B:
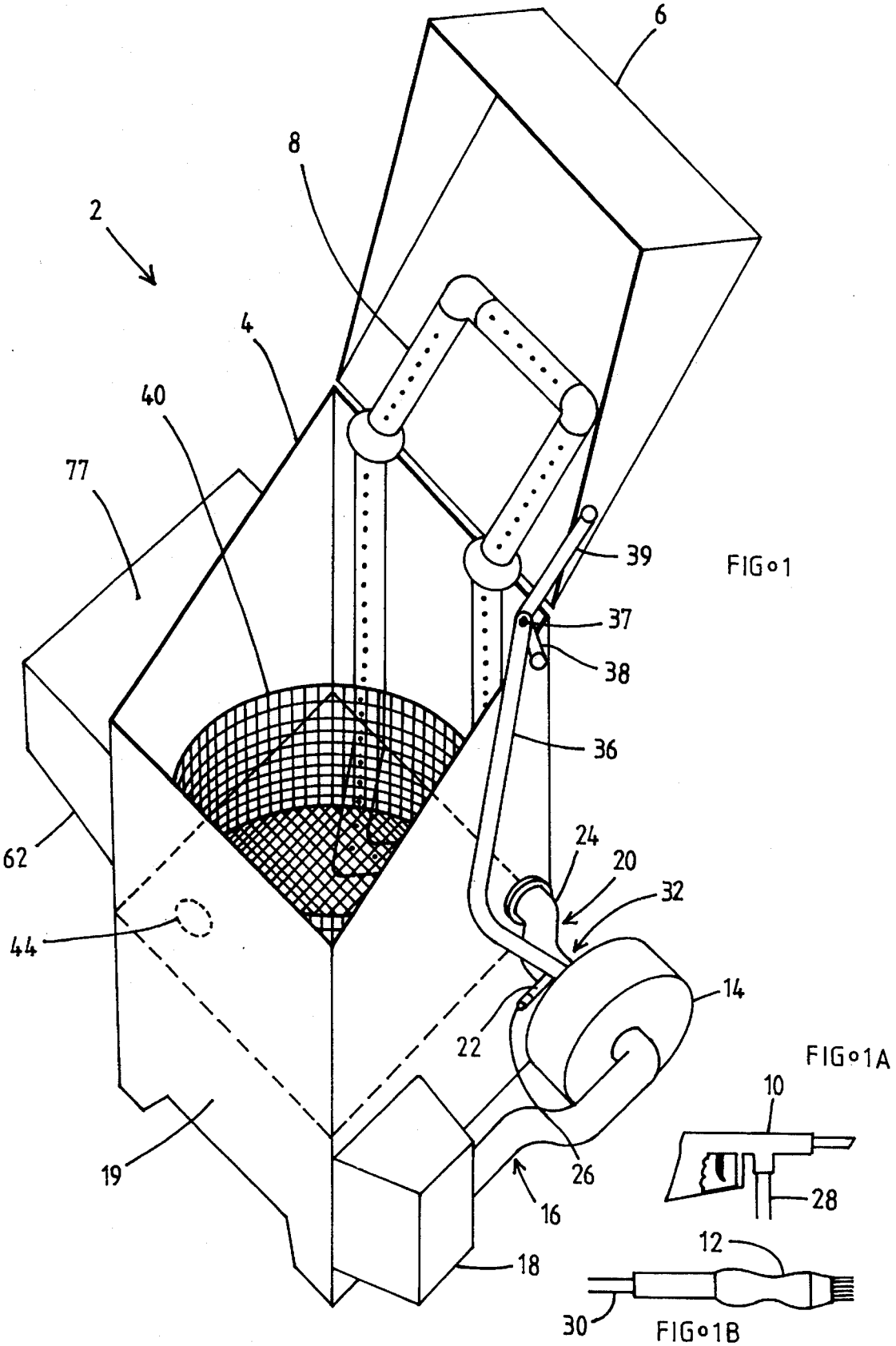
FIG. 1 is a perspective view of the cleaning apparatus from the front.
FIG. 1A is an enlarged view of a gun for dispensing cleaning fluid into the cleaning apparatus of FIG. 1.
FIG. 1B is an enlarged view of a brush 12 for dispensing cleaning fluid into the cleaning apparatus of FIG. 1.
Figure 2:
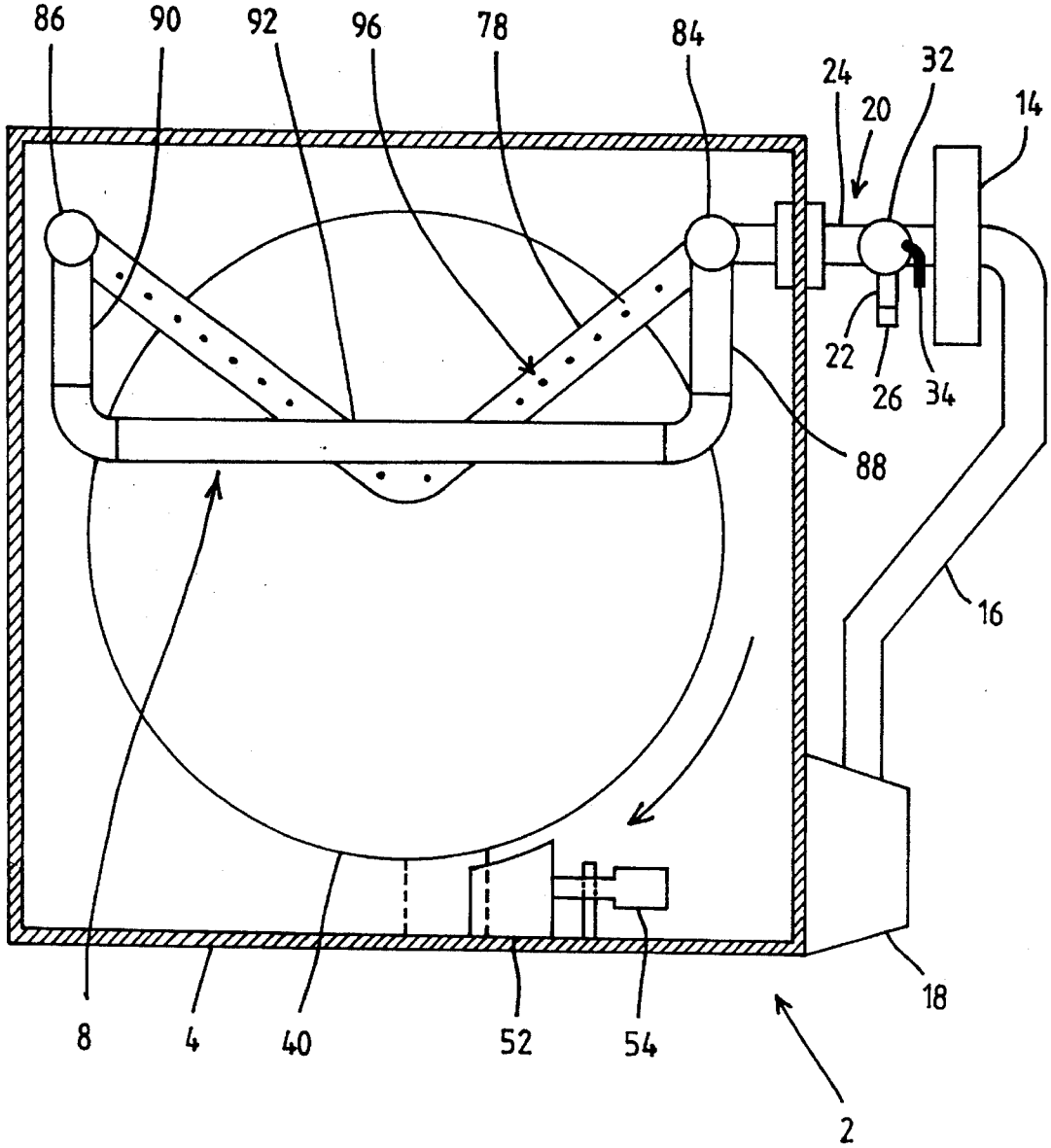
FIG. 2 is a plan view of the cleaning apparatus with a lid in an opened position.

As shown in the accompanying drawings with particular reference to FIGS. 1 and 2, a cleaning apparatus 2 for cleaning articles comprises a trough 4 in which cleaning of the articles can be performed, a lid 6 connected to the trough and movable between a closed position covering the trough and an open position to allow access to the trough, a first cleaning fluid dispensing means in the form of a manifold 8 located within the apparatus 2 and, a second portable cleaning fluid dispensing means in the form of a gun 10 or brush 12 which is connectable to the apparatus 2. The lid 6 operatively cooperates with the manifold 8, gun 10 and brush 12 in such a manner that when the lid 6 is in the closed position, cleaning fluid can be dispensed through the manifold 8 and when the lid 6 is in the opened position, cleaning fluid can be dispensed through a connected one of the gun 10 or brush 12.

A pumping means in the form of pump 14 is provided for pumping the cleaning fluid to a selected one of the manifold 8, and, the gun 10 or brush 12. A receptacle in the form of a tank 19 is also provided to supply a volume of the cleaning fluid.

The pump 14 has an inlet 16 which communicates via a filter 18 with the tank 19, and two outlets 20, 22 in selective communication with the inlet 16 (seen most clearly in FIG. 2). The first outlet 20 is connected to the manifold 12 via pipe 24. The second outlet 22 is provided with a coupling 26 to facilitate connection with hoses 28 or 30 of gun 10 and brush 12 respectively. A ball valve 32 housed within the pump 14 selectively directs cleaning fluid to either the outlet 20 or outlet 22. The ball valve 32 is provided with a control arm 34, the manipulation of which changes the state of the ball valve 32. The control arm 34 is pivotably connected to one end of a lever 36. An opposite end of lever 36 is pivotably connected by pivot pin 37 to arms 38 and 39. An end of arm 38 distant from lever 36 is pivotably connected to an outside wall of the trough 4 in the vicinity of the lid 6. An end of arm 39 distant from lever 36 is pivotably connected to lid 6. The arms 38 and 39 assists in stabilising the movement of lever 36 as the lid 6 is moved between its open and closed positions.

Figure 4:
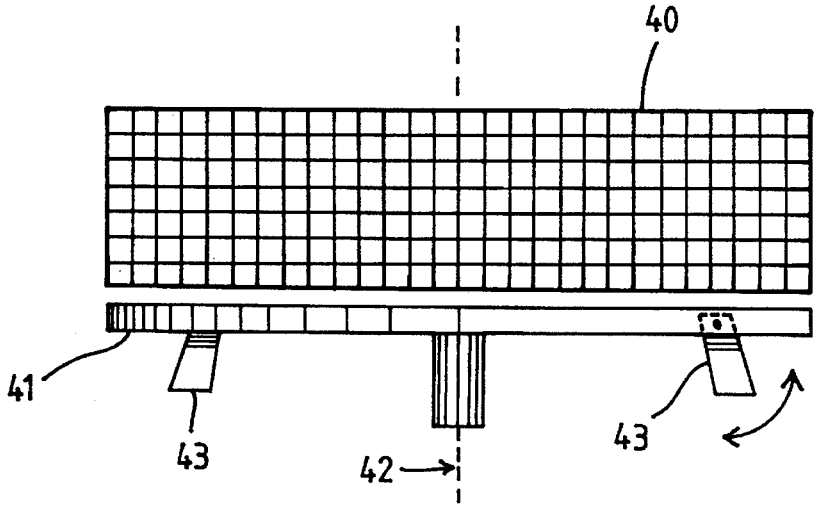
FIG. 4 is a front view of a basket and speed governing system used in the cleaning apparatus.

A wire mesh basket 40 (refer FIGS. 1 and 4) is disposed in the trough 4 for holding the articles to be cleaned. The basket 40 is supported on a turntable 41 which is rotated about axis 42 by a water jet (not shown) produced by pump 10. To this end, a plurality of vanes 43 in the form of metal plates are disposed about the periphery of the turntable 41. The vanes 43 are arranged to successively cut across the path of the water jet so as to act as impellers to rotate the turntable 41. The vanes 43 are further arranged to swing or pivot outwardly under the influence of centrifugal force as the speed of rotation of the basket increases. As the vanes 43 swing outwardly, they move out of the path of the water jet so as to reduce the contact area with the water jet. At a maximum speed of rotation of the basket, the vanes 43 swing to a position in which they are no longer impinged by the water jet. This provides automatic rotational speed control for the basket 40. In an alternative arrangement, the vanes 43 can be provided directly on the basket 40 rather than on the turntable 41.

As the basket 40 rotates, the relative position of the articles to be cleaned and the manifold 8 varies to ensure thorough and complete cleaning. A drain 44 is provided so that cleaning fluid entering the trough 4 returned to the tank 19 and re-circulated. The apparatus 2 further includes a heater (not shown) for heating the cleaning fluid prior to dispensing through the manifold 8 or one of the gun 10 or brush 12.

Figure 5:
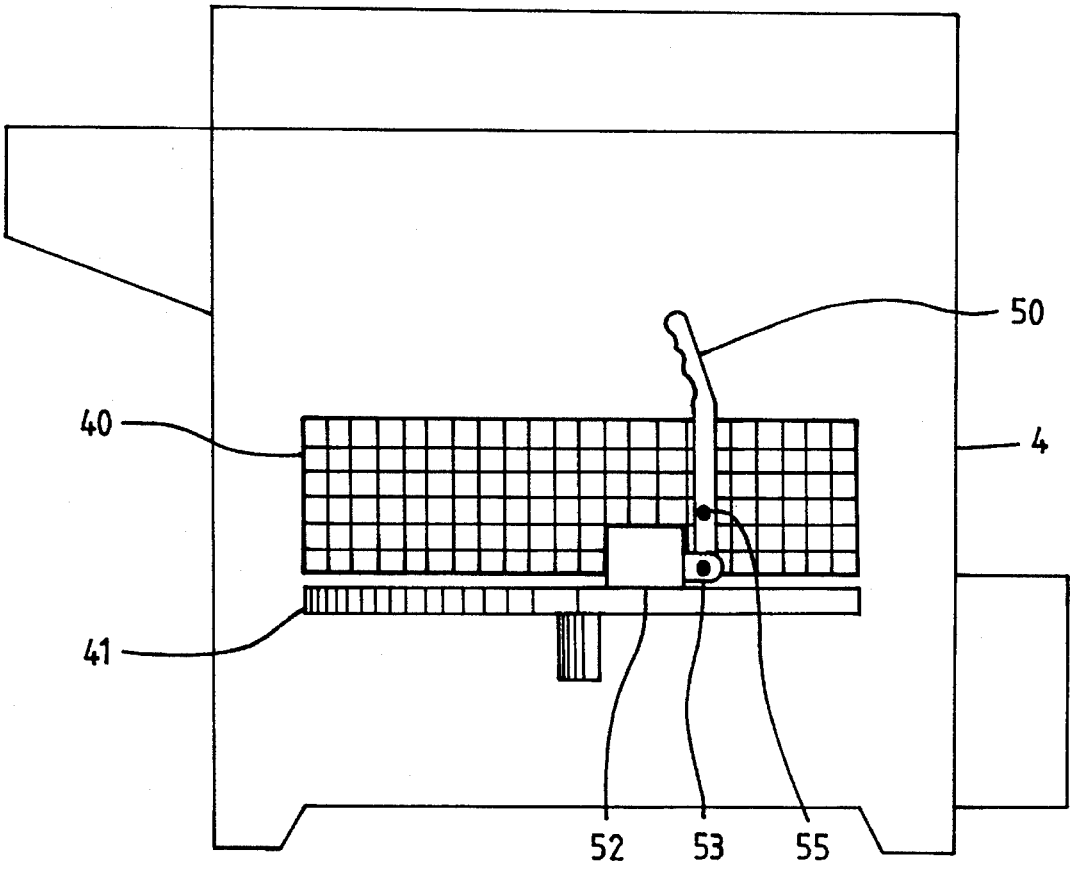
FIG. 5 is a partial cutaway view of the cleaning apparatus from the side.

When heavy and/or many articles are cleaned at the same time, the angular momentum of the basket may cause it to continue rotating at relatively high speed for an extended period of time after the lid 6 has been moved to the opened position. There is an inherent danger to personal safety in attempting to stop the basket by hand. However, in order to reduce cleaning time and thus operating costs, such action is often taken by users of the present type of cleaning apparatus 2. To reduce cleaning time and increase operating safety, the apparatus 2 can also be provided with a brake 50 (refer FIGS. 2 and 5) for retarding the rotation of the basket 40.

The brake 50 includes a wedge-shaped block 52 which is slidably mounted on an inside wall of the trough 4 adjacent the basket 40. A hand lever 54 is pivotally connected at one end with a lug 53 extending from block 52 and also pivotally connected intermediate of its length by pivot pin 55 to the inside wall of trough 4. By manipulating the lever 54 to pivot about pin 55 the block 52 can be slid into contact with a circumferential wall of the basket 40 and thus retard its rotation (shown in phantom in FIG. 2). The block 52 is arranged to slide into contact with the basket 40 in the direction of the tangent of rotation of the basket 40. This minimises the effort required to brake the basket as the motion of the basket itself tends to drag the brake block 52 in the required direction of motion in order to effect braking of the basket 40. The brake block 52 when used, becomes wedged between the basket and the side wall of the trough 4.

A spring or other biasing means (not shown) can be provided to automatically move the brake block 52 out of contact with the basket 40 after braking has been effected. Alternatively, the hand lever 54 can be arranged to move the brake block 52 out of contact with the basket 40. It is preferable for manufacturing reasons for the brake 50 to be wholly located within the trough 4o However, the brake can also be constructed to be foot or hand operated from outside the trough 4. Also, the brake 50 can be connected with the lid 6 so as to operate automatically while moving the lid 6 to the opened position.

Figure 6:
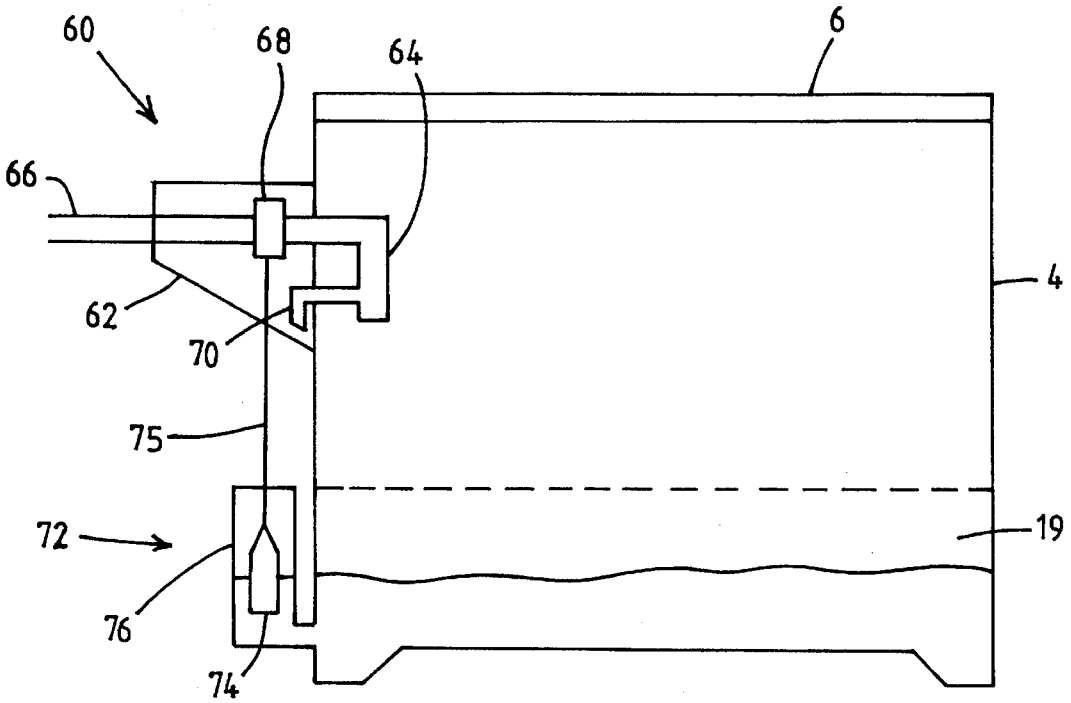
FIG. 6 is a partial cutaway view of the cleaning apparatus from the front showing an automatic cleaning fluid recharge system; and, FIG. 7 is a perspective view of a manifold and basket used in the cleaning apparatus.

An automatic cleaning fluid recharge system 60 (refer FIG. 6) can be connected to the apparatus 2 to extend the time between recharging of the cleaning fluid. The system 60 includes a detergent container 62 attached to an outside surface of the trough 4 for dispensing a mixture of water and detergent into the tank 19. Discharge nozzle 64 extends from the container 62 into the trough 4. An end of the nozzle 64 located in the container 62 is connected by a hose 66 to a mains water supply. The flow of water through the nozzle 64 is controlled by a valve 68. A small tube 70 having opened ends communicates between the interior of the container 62 and the nozzle 64. The sensor 72 is provided for sensing the volume of cleaning fluid within the tank 19. The sensor includes a float 74 housed within a housing 76 which is in fluid communication with the tank 19. The float 74 is connected by tether 75 to the valve 68. When the volume of cleaning fluid which is a mixture of water and detergent within the tank 8 falls below a predetermined level, the float 74 drops which causes valve 68 to open. As water passes through nozzle 64, detergent is drawn into the nozzle through tube 70 by the venturi effect and mixed in a predetermined ratio with the water. This allows the apparatus to automatically recharge itself until the detergent within the container is exhausted. At this time, the apparatus 2 can undergo routine maintenance and complete recharging. The top surface 77 of the container 62 can also act as a table or shelf to support articles before or after cleaning.

The method of operation of the cleaning apparatus 2 will now be described.

The tank 19 is prefilled with a cleaning fluid such as water and a suitable detergent, (rust inhibitors can also be added). The lid 6 is opened and articles to be cleaned are placed within the basket 40. The lid 6 is now moved to the closed position to cover the trough 4. When moving the lid 6 to the closed position, the lever 36 rotates the control arm 34 so that the ball valve 32 connects the pump inlet 18 with the pump outlet 20. On activation a master switch (not shown) the pump 14 draws water and detergent from the tank 8 through the filter 18 into inlet 16, out of outlet 20, through connecting pipe 24 to the manifold 8. The water and detergent mixture is then sprayed from the manifold 8 toward the basket 40. Simultaneously, the basket 40 is rotated about axis 42 by the water jet. The pump 14 is of a capacity so as to ensure that water spraying from the manifold 8 is under higher pressure. The combination of the rotation of the basket 40 together with high pressure water and detergent spraying from all sides cleans the articles in the basket 40. The water and detergent entering the trough 4 is returned to the tank 19 through drain 44. Grime, dirt and other bodies removed from the articles during cleaning is prevented from entering the pump 14 by the filter 18.

Figure 3:
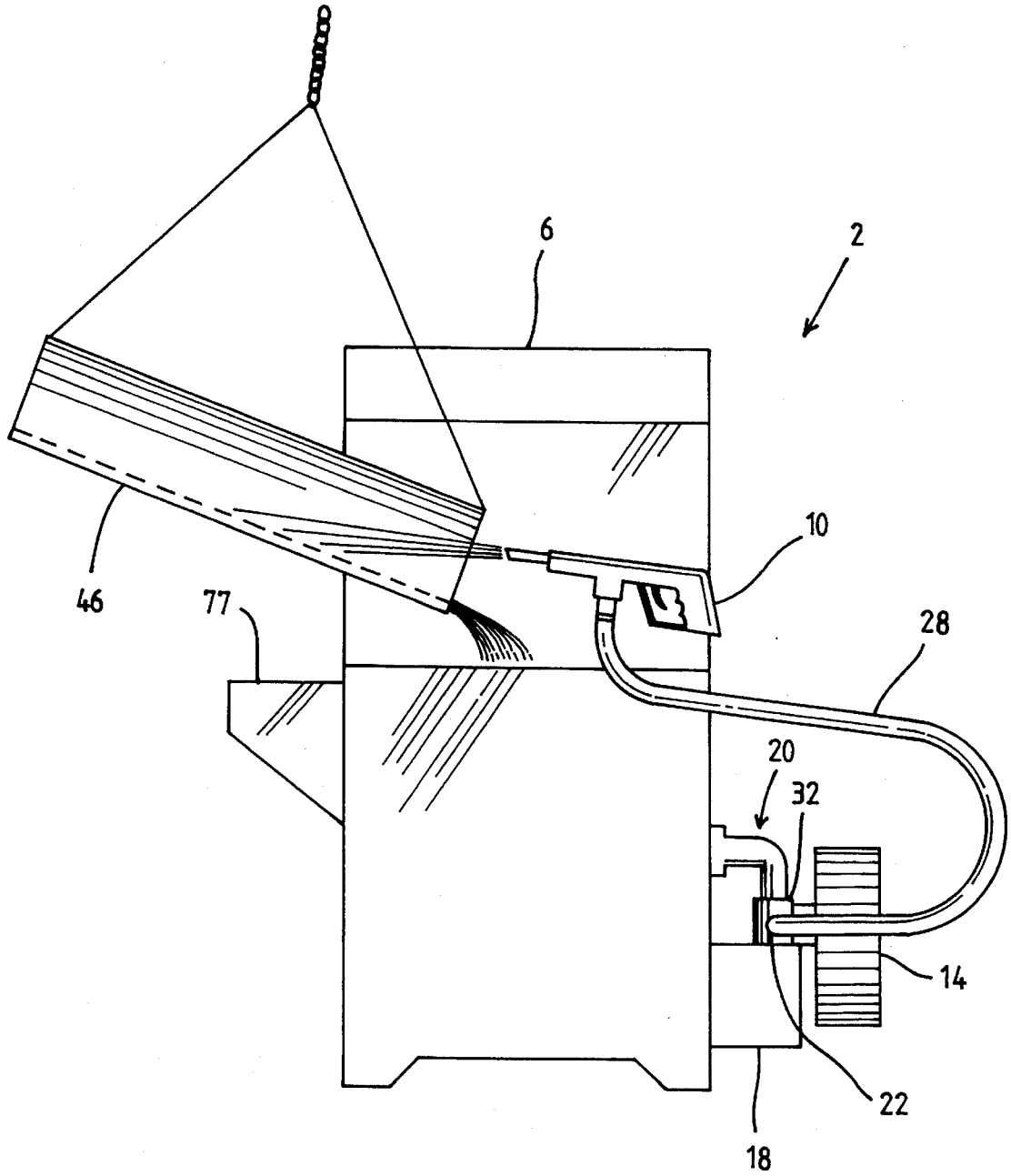
FIG. 3 is a elevation view of the cleaning apparatus from the front.

When the article to be cleaned is too large to fit within the trough 4, the gun 10 or brush 12 may be used for cleaning. For example, take the instance where it is desired to clean a hydraulic cylinder 46 having a length of 2 meters and diameter of 400 mm, as shown in FIG. 3. The gun 10 is connected via hose 28 with the second outlet 22 of the pump 14. With the lid 6 in the open position, the lever 36 rotates the control arm 34 in a clockwise direction so that ball valve 32 now connects pump inlet 16 with the pump outlet 22. 0n activation of the master switch, the pump 14 draws water and detergent from the tank 19 through filter 18, inlet 16 and out through outlet 22 to hose 28 and gun 10. The hydraulic cylinder 46 is cleaned by directing a jet of cleaning fluid emanating from the gun 10 into the cylinder 46. The cylinder 46 is inclined and has its opened end above trough 4 to return the via drain 44, to the tank 19.

Figure 7:
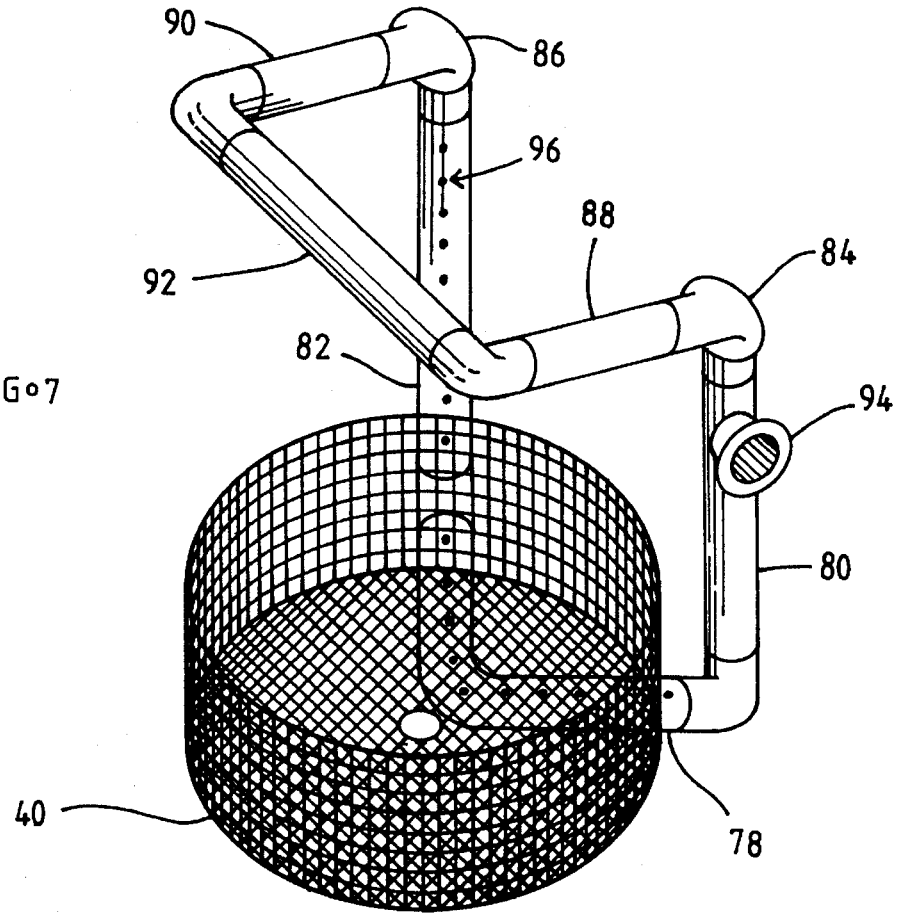

The manifold 8 is advantageously arranged as a closed loop which ensures that the cleaning fluid pressure is equalised throughout the manifold 8, (refer FIGS. 2 and 7). The manifold 8 is configured so as to spray cleaning fluid from above, under and the sides of the basket 40. The manifold 8 comprises a V-shaped pipe 78 extending underneath the basket 40 with the apex of the "V" located near the centre of the basket 40. Opposite ends of the V-shaped pipe 78 are connected to swivel joints 84,86 respectively and extend toward the centre of the basket 40. A straight length of pipe 92 is connected between the opposite ends of pipes 88 and 90 and extends above the basket 40 to complete the manifold 8. A cleaning fluid inlet 94 is provided on pipe 80 for coupling with the pump outlet 20.

A series of holes 96 are drilled or otherwise formed in the pipes 78, 80, 82, 88, 90, 92 to allow the spraying of cleaning fluid from the manifold 8. This configuration creates two curtains of cleaning fluid spray emanating from above, under and to one side of the basket 40 through which each part to be cleaned passes during every revolution of the basket 4. The two curtains of spray ensure very quick and thorough cleaning and thereby assist in reducing operating cost.

The swivel joints 84, 86 are formed to allow the flow of cleaning fluid within the manifold. In addition, the joints 84, 86 permit the pipes 88, 90 and 92 to be connected with the lid 6 so that they can be pivoted away from the basket 40 for loading or unloading of parts when the lid is lifted.

From the above description, it is apparent that the above embodiment has numerous advantages over the prior art. When the articles to be cleaned can fit within the basket 40, cleaning is performed automatically without requiring an operator to attend the apparatus during a complete washing cycle. The detachable gun 10 and brush 12 in combination with the mechanism for selectively directing the cleaning fluid thereto allows the efficient cleaning of large articles which hitherto was a particularly difficult and time consuming task. When the gun 10 or brush 12 is used the run off is returned into the trough 4. This maintains the work area dry, improving work safety, and also reduces waste and thus operating costs because the returned run off is re-circulated. This further avoids the need to purchase and maintain separate cleaning apparatus for articles of different size. As cleaning is effected by means of water and detergent, the expense and hazards of using solvent cleaners is avoided. In addition, as the water is heated, the articles being cleaned absorb heat which permits them to "flash dry" . This eliminates the need to rinse or blow dry the cleaned articles. As the cleaning water is re-circulated smaller volumes of water can be used for cleaning and the volume of industrial waste produced (i.e. water containing oil, grease, detergent, etc.) is reduced.

Figure 2A:
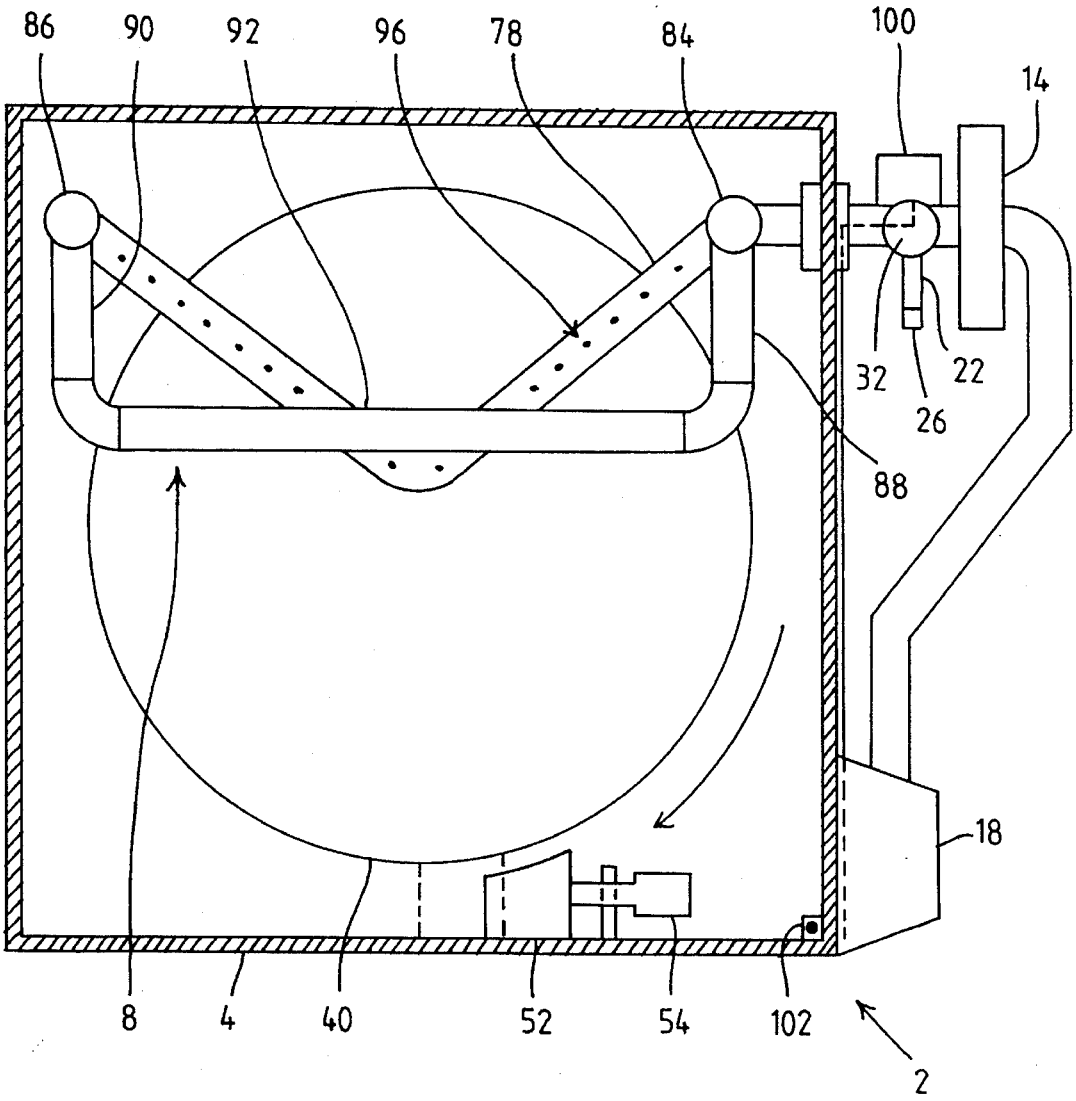
FIG. 2A is a plan view of the cleaning apparatus of FIG. 2 illustrating an electrical controller for operating a valve for selectively directing cleaning fluid to first and second cleaning fluid dispensers.
Figure 2B:
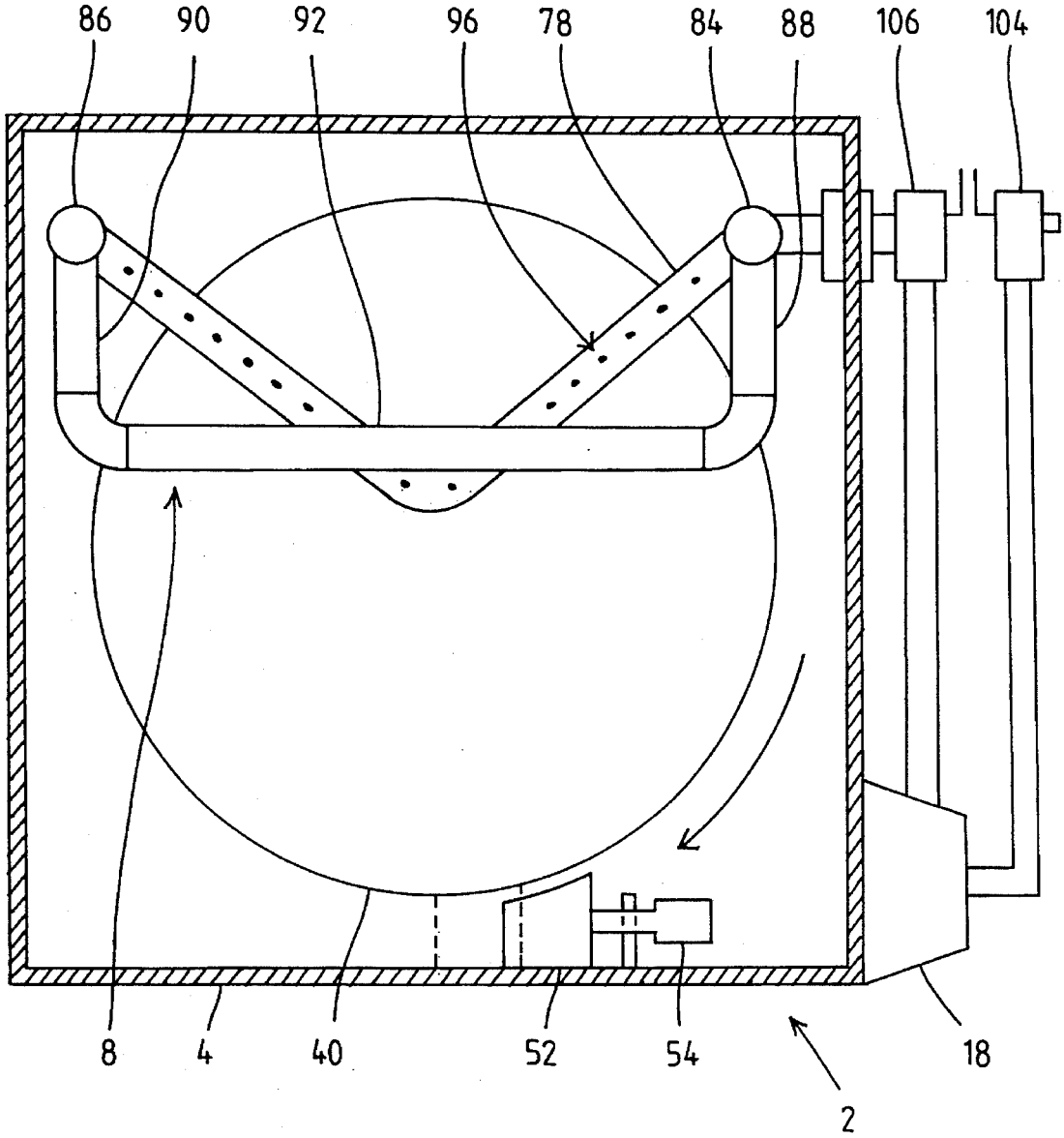
FIG. 2B is a plan view of the cleaning apparatus of FIG. 2 illustrating first and second pumps for pumping cleaning fluid into the cleaning apparatus.

Now that an embodiment of the present invention has been described in detail, it will be apparent to those skilled in the relevant arts that numerous modifications and variations may be made without departing from the basic inventive concepts. For example, the ball valve 32 is illustrated as being operated by means of a lever 36 connected with the lid 6. However, electrical control means 100 (see FIG. 2A), for example, solenoids or electric motors may be used to control the ball valve 32. The electrical control means+can be activated by an associated switch 102 which may be operated directly by the lid 6, or by a lever arrangement attached to the lid 6. Other types of valves, for example, flap valves may be used in place of the ball valves 32. Alternatively, two separate pumps 104, 106 (see FIG. 2B) can be used, one for directing cleaning fluid to each of the manifold 8, and, the gun 10 or brush 12, with the position of the lid 6 selectively enabling respective ones of the pumps. The pumps may of course be of different pressure ratings. It will further be appreciated that the manifold 8 may be of any geometry provided it directs cleaning fluid to the basket 40. In particular, the manifold may be configured to produce any number of spray curtains through which the articles to be cleaned pass on every revolution of the basket 40. All such modifications and variations are deemed to be within the scope of the present invention, the nature of which is to be determined from the following description.

The claims defining the invention are as follows:

1. A cleaning apparatus for cleaning articles, said apparatus comprising:

a trough in which cleaning of said articles can be performed;

a lid connected to said trough and movable between a closed position covering said trough and an opened position to allow access to said trough;

a first cleaning fluid dispensing means located within said apparatus and a second portable cleaning fluid dispensing a receptacle for containing a volume of said cleaning fluid, said receptacle communicating with said dispensing means and said trough so that cleaning fluid can be recirculated through said apparatus; and pumping means including a valve for selectively pumping said cleaning fluid to said first or second cleaning fluid dispensing means, wherein said lid operatively cooperates with said valve in a manner such that when the lid is in the closed position, the pumping means can pump the cleaning fluid via the valve to said first cleaning fluid dispensing means, and when the lid is in the opened position, the pumping means can pump the cleaning fluid via the valve to the second portable cleaning fluid dispensing means.

2. An apparatus according to claim 1, further comprising electrical control means for operating said valve, said electrical control means including an associated switch, wherein said associated switch activates said electrical control means to cause said valve to direct cleaning fluid to said first cleaning fluid dispensing means when the lid is in the closed position, and to cause the valve to direct cleaning fluid to the second portable cleaning fluid dispensing means when the lid is in the opened position.

3. An apparatus according to claim 1, further comprising a basket disposed within said trough for holding said articles, said basket adapted to allow cleaning fluid to flow therethrough.

4. An apparatus according to claim 3, further comprising means for rotating said basket to vary the position of an article contained with the basket relative to one of said cleaning fluid dispensing means.

5. An apparatus according to claim 4, wherein said means for rotating comprises a jet of said cleaning fluid, a rotatable support for supporting said basket, and a plurality of vanes connected to said support which can successively enter said jet of cleaning fluid to act as impellers to rotate said rotatable support and a basket support thereon.

6. An apparatus according to claim 5, wherein each of said vanes is pivotally connected to said support whereby the action of centrifugal force on said vanes due to the rotation of said support causes said vanes to swing out of the path of said jet to thereby limit the speed of rotation of said support.

7. An article according to claim 4, further comprising a braking means for retarding the rotation of said basket when the lid is in the opened position.

8. An apparatus according to claim 7, wherein said braking means comprises a brake block and an actuator connected to the brake block for moving said brake block into contact with said basket to retard the rotation of said basket.

9. An apparatus according to claim 8, wherein said brake block is arranged for wedging between said basket and an inside surface of said trough to thereby retard rotation of said basket.

10. An apparatus according to claim 9, wherein said actuator is in the form of a hand operable lever disposed within said trough.

11. A cleaning apparatus according to claim 4, wherein said first cleaning fluid dispensing means comprises a manifold arranged in a closed loop.

12. A cleaning apparatus according to claims 11, wherein said manifold is configured to spray cleaning fluid from above, underneath and a side of the basket.

13. A cleaning apparatus according to claim 12, wherein said manifold is further configured to produce two spray curtains of cleaning fluid each spray curtain including fluid emanating from above, underneath and to one side of the basket, whereby each article passes through each spray curtain during every revolution of said basket.

14. An apparatus according to claim 1, wherein said cleaning fluid is a combination of water and detergent.

15. An apparatus according to claim 14, further comprising:

an automatic cleaning fluid recharge system, said system including a sensor communicating with said receptacle for sensing the volume of cleaning fluid in said receptacle;

a container for holding a supply of detergent;

a water supply means for supplying water to said receptacle, said water supply means including a valve for controlling the flow of water into said receptacle and which is operatively connected with said sensor; and a tube communicating between said water supply means and said container, wherein, when said sensor senses the volume of said cleaning fluid is less than a predetermined volume, said sensor operates said volume to admit water into said receptacle whereby the flow of water through said water supply means causes detergent to flow through said tube into the water supply means so as to mix with water flowing into the receptacle thereby providing automatic recharging of said cleaning fluid.

16. A cleaning apparatus for cleaning articles, said apparatus comprising:

a trough in which cleaning of said articles can be performed;

a lid connected to said trough and movable between a closed position covering said trough and an opened position to allow access to said trough;

a first cleaning fluid dispensing means located within said apparatus and a second portable cleaning fluid dispensing means;

a receptacle for containing a volume of said cleaning fluid, said receptacle communicating with said dispensing means and said trough so that cleaning fluid can be recirculated through said apparatus; and, pumping means for pumping said cleaning fluid to said first and second cleaning fluid dispensing means, said pumping means comprising a first pump in communication with said receptacle for pumping said cleaning fluid to said first cleaning fluid dispensing means and a second pump in communication with said receptacle for pumping said cleaning fluid through said second portable cleaning fluid dispensing means, wherein said lid operatively cooperates with said pumping means in a manner such that when the lid is in the closed position, the first pump can pump the cleaning fluid to said first cleaning fluid dispensing means, and when the lid is in the opened position, the second pump can pump the cleaning fluid to the second portable cleaning fluid dispensing means.

17. An apparatus according to claim 16, further comprising a basket disposed within said trough for holding said articles, said basket adapted to allow cleaning fluid to flow therethrough.

18. An apparatus according to claim 17, further comprising means for rotating said basket to vary the position of an article contained with the basket relative to one of said cleaning fluid dispensing means.

19. An apparatus according to claim 18, wherein said means for rotating comprises a jet of said cleaning fluid, a rotatable support for supporting said basket, and a plurality of vanes connected to said support which can successively enter said jet of cleaning fluid to act as impellers to rotate said rotatable support and a basket support thereon.

20. An apparatus according to claim 19, wherein each of said vanes is pivotally connected to said support whereby the action of centrifugal force on said vanes due to the rotation of said support causes said vanes to swing out of the path of said jet to thereby limit the speed of rotation of said support.

21. An article according to claim 18, further comprising a braking means for retarding the rotation of said basket when the lid is in the opened position.

22. An apparatus according to claim 21, wherein said braking means comprises a brake block and an actuator connected to the brake block for moving said brake block into contact with said basket to retard the rotation of said basket.

23. An apparatus according to claim 22, wherein said brake block is arranged for wedging between said basket and an inside surface of said trough to thereby retard rotation of said basket.

24. An apparatus according to claim 23, wherein said actuator is in the form of a hand operable lever disposed within said trough.

25. A cleaning apparatus according to claim 18, wherein said first cleaning fluid dispensing means comprises a manifold arranged in a closed loop.

26. A cleaning apparatus according to claim 25, wherein said manifold is configured to spray cleaning fluid from above, underneath and a side of the basket.

27. A cleaning apparatus according to claim 26, wherein said manifold is further configured to produce two spray curtains of cleaning fluid, each spray curtain including cleaning fluid emanating from above, underneath and to one side of the basket, whereby each article passes through each spray curtain during every revolution of said basket.

28. An apparatus according to claim 16, wherein said cleaning fluid is a combination of water and detergent.

29. An apparatus according to claim 28, further comprising:

an automatic cleaning fluid recharge system, said system including a sensor communicating with said receptacle for sensing the volume of cleaning fluid in said receptacle;

a container for holding a supply of detergent;

a water supply means for supplying water to said receptacle; said water supply means including a valve for controlling the flow of water into said receptacle and which is operatively connected with said sensor; and a tube communicating between said water supply means and said container, wherein, when said sensor senses the volume of said cleaning fluid is less than a predetermined volume, said sensor operates said valve to admit water into said receptacle whereby the flow of water through said water supply means causes detergent to flow through said tube into the water supply means so as to mix with water flowing into the receptacle thereby providing automatic recharging of said cleaning fluid.

* * * * *